US006338787B1

(12) United States Patent
Obata et al.

(10) Patent No.: US 6,338,787 B1
(45) Date of Patent: Jan. 15, 2002

(54) REDOX SYSTEM ELECTROLESS PLATING METHOD

(75) Inventors: Keigo Obata; Dong-Hyun Kim; Takao Takeuchi; Seiichiro Nakao, all of Hyogo-ken; Shinji Inazawa, Osaka; Ayao Kariya, Toyama; Masatoshi Majima; Shigeyoshi Nakayama, both of Osaka, all of (JP)

(73) Assignees: Daiwa Fine Chemicals Co., Ltd., Hyogo-ken; Sumitomo Electric Industries, Ltd., Osaka, both of (JP)

( * ) Notice: Subject to any disclaimer, the term of this patent is extended or adjusted under 35 U.S.C. 154(b) by 0 days.

(21) Appl. No.: 09/543,356

(22) Filed: Apr. 5, 2000

(30) Foreign Application Priority Data

Apr. 6, 1999 (JP) ..... 11-098996
Feb. 7, 2000 (JP) ..... 12-029349

(51) Int. Cl.[7] ..... C25C 1/00

(52) U.S. Cl. ..... 205/687; 205/101; 427/304; 427/437; 427/561

(58) Field of Search ..... 205/101, 687; 427/561, 304, 437

(56) References Cited

U.S. PATENT DOCUMENTS 4,425,205 A * 1/1984 Honma et al.
4,734,175 A * 3/1988 Bissinger
5,730,856 A * 3/1998 Omasa ..... 205/742
6,120,673 A * 9/2000 Reiter et al. ..... 205/611

FOREIGN PATENT DOCUMENTS

JP 60-125379 7/1985
JP 3-191070 8/1991
JP 4-325688 11/1992
JP 6-101056 4/1994
JP 6-264248 9/1994
JP 6-340979 12/1994

OTHER PUBLICATIONS

"Electroless Copper Plating Using Co(II) Compound as Reducing Agent", S. Nakao et al., The Surface Finishing Society of Japan Summary Report of the 98th Conference, 19A–34, pp. 33–34, Aug. 1998.

"The Autocatalytic Deposition of Tin", M. E. Warwick et al., Transactions of the Institute of Metal Finishing, month of publication not available 1980, vol. 58, pp. 9–14.

* cited by examiner

*Primary Examiner*—Kathryn Gorgos
*Assistant Examiner*—William T. Leader
(74) *Attorney, Agent, or Firm*—McDermott, Will & Emery

(57) ABSTRACT

To provide a plating method, which enables wide industrial use of the redox system electroless plating method having excellent characteristics, and a plating bath precursor which is preferable for the plating method. The plating method comprises a process oxidizing first metal ions of a redox system of a plating bath from a lower oxidation state to a high oxidation state, and second metal ions of said redox system are reduced and deposited onto the surface of an object to be plated, wherein a process is provided in which by supplying the electrical current to the plating bath, the first metal ions are reduced from said lower oxidation state to thereby activate the plating bath. The plating bath precursor is formed stabilizing the plating bath so that reduction and deposition of the second metal ions substantially do not occur in order to improve its storing performance.

13 Claims, 2 Drawing Sheets

REDOX SYSTEM ELECTROLESS PLATING METHOD

BACKGROUND OF THE INVENTION

1. Field of the Invention

The present invention relates to a new plating method and a plating bath precursor to be used therefor.

2. Description of the Related Art

A wet plating method for reducing metal ions in a bath and depositing the ions onto the surface of an object to be plated is classified roughly into an electroplating (electrolyzing deposition) method and an electroless plating (chemical deposition) method on the basis of the reduction mechanism as generally known. Both methods have merits and demerits.

For example, the electroplating method has advantages whereby, during plating, metal ions of basically the same amount as that of the metal deposited on the surface of the object to be plated are supplied from the anode, and the composition of a plating bath is maintained roughly constant, and therefore, said plating bath can be continuously used over a long period of time, however, it also has the following problems:

- The object to be plated is limited to an object at least whose surface is electrically conductive.
- Depending on the form of the object to be plated, since an electric charge is particularly easily concentrated onto a convex portion thereon, the thickness of the plated layer easily becomes uneven.

On the other hand, the electroless plating method has advantages whereby, the material of the object to be plated is not basically material of the restricted, and also, regardless of the form of the object to be plated, the thickness of the plated layer can be made even, however, it also has following problems:

- Depending on the material of the plating metal and the object to be plated, catalysis processing by means of a palladium compound is necessary, and the production cost is high.
- Since a reducing agent used for reduction of metal ions accumulates in the bath as oxidized form, and since unnecessary components inevitably contain in the plating bath by supplying a new reducing agent and metal ions to maintain the plating bath which was consumed during the plating, the composition and concentration of the bath easily change, whereby the life of the plating bath is limited.
- Since the electroless plating is a metal deposition method using self-catalysis, deposition of a catalyst-poisonous metal is difficult, whereby metal types which can be used for plating are limited.

Therefore, in order to solve the above problems in the prior-art electroless plating method, Warwick et al proposed a new electroless plating method (called a "redox system electroless plating method" for distinction from the prior-art conventional electroless plating method), wherein, by oxidizing first metal ions of a redox system of a plating bath from a lower oxidation state to a high oxidation state, and second metal ions of said redox system are reduced and deposited onto the surface of an object to be plated (M. E. Warwick and B. Shirley; The Autocatalitic Deposition of Tin, Trans. Inst. Metal Finishing, 58, 9(1980)).

That is, in the above document, Warwick et al presented that, when $Ti^{3+}$ in a plating bath was oxidized to $Ti^{4+}$ (or $TiO^{2+}$ in a real existing form), by using a phenomenon in that $Sn^{2+}$ ions existing in the same bath were reduced to metal tin, tin autocatalytic electroless deposition which had been considered impossible by the prior-art electroless plating method was achieved, whereby they took the initiative of a redox system electroless plating method.

Thereafter, many researchers have studied the application of this redox system electroless plating method to various metal plating.

For example, in Japanese Laid-open Patent Publication No. 125379 of 1985, a gold electroless-plating bath using $Ti^{3+}$ as a reducing agent is disclosed.

Also, in Japanese Laid-open Patent Publication No. 191070 of 1991, nickel, zinc, silver, cadmium, indium, antimony, and lead electroless plating bath using $TiCl_3$ as a reducing agent are disclosed, and in Japanese Laid-open Patent Publication No. 325688 of 1992, the abovementioned various metal electroless plating bath using trivalent titanium chloride in place of $TiCl_3$ are disclosed.

Also, in Japanese Laid-open Patent Publication No. 101056 of 1994, a tin-lead alloy using $Ti^{3+}$ as a reducing agent, that is, an electroless plating bath for solder is disclosed.

Also, in Japanese Laid-open Patent Publication No. 264248 of 1994, a description is given in that, in the abovementioned redox system electroless plating method, a carbonate such as sodium carbonate or potassium carbonate is used in place of ammonia which is normally used for adjusting pH of the plating bath.

Furthermore, in Japanese Laid-open Patent publication No. 340979 of 1994, a copper plating bath, which contains thiourea as a complex forming agent of metal ions, and uses Ti3+ as a reducing agent, is disclosed, and it has been reported that this copper can be deposited even by using $Co^{2+}$ in place of $Ti^{3+}$ as a reducing agent (pages 33–34 of "Summary report of 98th Conference", Surface Technology Society, 1998, Seiichiro Nakao, Hidemi Nawafune, Shozo Mizumoto, Yoshiki Murakami, and Shin Hashimoto)

As mentioned above, the redox system electroless plating method has the following advantages as in the prior-art conventional electroless plating method:

- basically, the material of an object to be plated is not limited, and
- the plated layer can be made even in thickness regardless of the form of the object to be plated, and further, has the following additional advantages:

- as well as various metals which can be used for plating in the prior-art electroless plating method, as mentioned above, while catalyst-poisonous metals such as tin, lead, and antimony which cannot be used for the autocatalytic electroless plating in the prior-art it is possible to use them with electroless plating,
- since the speed of the oxidation and reduction reaction in the redox system is faster than that of the reduction reaction of the metal ions by a reducing agent in the prior-art of electroless plating method, element such as phosphorous and boron contained in a reducing agent are co-deposited in the plated layer and there is a possibility that a plated layer can be formed more efficiently and faster than in the prior-art,
- in the prior-art of electroless plating method, element such as phosphorus and boron contained in a reducing agent are co-deposited in the plated layer, and this may influence electrical, mechanical, or chemical properties of the plated layer, however, in the redox system electroless plating method, since the reducing agent containing these elements is not used, a plated layer which is made from a pure metal without containing co-deposits, is excellent in that the above properties can be formed, and therefore, for various fields in which the electroless plating method has not been employable for forming a plated layer due to the abovementioned co-deposits, the possibility of using a redox system electroless plating method can be used arises.

However, in actuality, the redox system electroless plating method is not widely used in industry although it has many advantages as mentioned above.

The reason for this is that activity of the redox system reaction is extremely high.

That is, a redox system plating bath is unstable since it is high in activity of the system reaction as mentioned above, suspended deposition easily occurs, and when such deposition occurs, an even plated layer may not be formed.

Also, the redox system plating bath initially has a fast reaction speed since it has high activity as mentioned above, and this is advantageous in one aspect of the redox system electroless plating method as mentioned above, however, a new problem is caused whereby the life of the plating bath is shortened.

As for the former problem concerning the stability of the plating bath, for example, by examination of a complex forming agent conducted by Obata among the present inventors together with other researchers (Japanese Laid-open Patent Publication No. 185759 of 1985), some worthy results have been obtained.

However, as for the latter problem concerning the shorter life of the plating bath, an essential solution has at present not been found.

That is, at a point in time a plating bath to be used in the redox system electroless plating method is made up by adding components, oxidation of metal ions composing the redox system and the reduction of metal ions forming the plated layer is started. Whether or not an object to be plated is dipped in the bath, oxidation and reduction proceed rapidly. The rate of progression is extremely fast in comparison with that of a reduction in metal ions by a reducing agent in the prior-art conventional electroless plating method.

Moreover, in the metal ions composing the redox system, some ions do not contribute to a reduction in metal ions to form a plated layer, but are oxidized by dissolved oxygen existing in the plating bath.

Therefore, the plating bath is rapidly activated in a short period of time; that is, it loses its reducing power, whereby the life of the plating bath is extremely shortened.

The life thereof is approximately 60 minutes at most, allowing the plating bath to be used for only one plating.

For example, in Japanese Laid-open Patent Publication No. 60376 of 1996, a method in that influence of dissolved oxygen is lowered as much as possible by adding antioxidant or by supplying inert gasses to the plating bath is disclosed, however, even by employing this method, the life of the plating bath cannot be remarkably lengthened, and therefore, the plating bath can still be used for only one plating.

Therefore, the plating method cannot be prepared and stored in advance, so that a problem occurs in that the required amount of plating bath is prepared immediately before each plating, and therefore, operation efficiency is extremely poor.

Moreover, since a regenerating method of a plating bath which lost activity has not been known thus far, the plating bath has been disposed after being used only once, whereby waste has been great.

Also, problems occur in waste bath disposal.

Therefore, while the redox system electroless plating method has various advantages as mentioned above it has not been used widely in industry.

The main object of the invention is to provide a new plating method, enabling the industrial and wide use of the redox system electroless plating method having excellent characteristics as mentioned above.

Another object of the invention is to provide a new plating bath precursor that can be preferably used for the above-mentioned plating method.

SUMMARY OF THE INVENTION

In order to solve the above problems, the present inventors variously examined the regenerating method of the plating bath to be used for the redox system electroless plating method.

As a result, by supplying an electrical current to the plating bath, when the metal ions of the redox system of the plating bath were reduced from a higher oxidation state to a low oxidation state, the bath was regenerated, whereby the bath was activated, enabling its use for plating.

It was also found that, when this activation process was combined with the plating process, the plating bath could be repeatedly used without limitation at an optional point in time after being prepared provided that the metal ions existed in the bath to form a plated layer, whereby the present invention was completed.

That is, the plating method of the invention is characterized in that, by oxidizing first metal ions of a redox system of a plating bath from a lower oxidation state to a high oxidation state, and second metal ions of said redox system are reduced and deposited onto the surface of an object to be plated, wherein a process is provided in which by supplying the electrical current to the plating bath, the first metal ions are reduced from said higher oxidation state to said lower oxidation state to thereby activate the plating bath.

The inventors also examined a plating bath storing method.

As a result, they found a method whereby the plating bath could be stored in the form of a so-called plating bath precursor which does not function as the plating bath by itself, that is, which was stable without the occurrence of reduction and deposition of the second metal ions.

In other words, even when this plating bath precursor is stored for a long period of time, since the second metal ions contained in the bath are prevented from being reduced and deposited freely during the period, the bath is regenerated as necessary by only reducing the first metal ions from a higher oxidation state to a lower oxidation state by supplying the electrical current, whereby the bath is activated, enabling it to be plated and used as a plating bath.

Therefore, the plating bath precursor of the invention comprises the first and second metal ions, and is made stable without reducing and depositing the second metal ions.

Also, at the "99th Conference of the Surface Technology Society" held recently, a presentation was made wherein a redox system electroless silver plating bath using $Co^{2+}$ as a reducing agent was added with a reducing agent whose reducing action was mild to selectively reduce oxidized cobalt ions ($CO^{3+}$) in the bath (page 54 of the "Summary report of 99th Conference", by Junichi Kawasaki, Ken Kobayashi, and Hideo Honma, Surface Technology Society 1999).

That is, the reported result was that, since an oxidation and reduction potential of sodium sulfite as a reducing agent was between that of cobalt ions equivalent to the first metal ions and that of the silver ions equivalent to the second metal ions, without reduction and deposition of silver ions ($Ag^+$) in the same bath, there was a possibility that only the oxidized cobalt ions ($Co^{3+}$) existing in the bath could be selectively reduced into active cobalt ions ($Co^{2+}$).

However, according to the examination by the inventors, this method has the following problems, and therefore, practical use of this method at an industrial level is considered difficult:

The reducing agent having the proper oxidation and reduction potential as mentioned above does not always exist in various combinations of the first and second metals, therefore this method cannot be applied to such combinations without the existence of the reducing agent.

Depending on the kind of reducing agent, co-deposits may occur as in the abovementioned prior-art conventional electroless plating.

If this method is repeated, and the plating bath is regenerated and used repeatedly, as in the case of the abovementioned prior-art conventional electroless plating, the reducing agent used for the reduction of metal ions accumulates in the bath as oxide, and therefore, the composition and concentration of the bath easily change, and the life of the plating bath is limited.

A report presented at the 99th Conference described an experiment using the abovementioned system. However, satisfactory results could not be obtained. In this presentation, the suggestion of the bath to be supplied with electrical current in place of a reducing agent was not mentioned.

On the other hand, according to the invention, as clearly understood from the results of the Examples described later, without the occurrence of the abovementioned various problems, excellent plating can be achieved. That is, as described later, if the electrical current density at the cathode when supplying an electrical current to the plating bath is adjusted, in various combinations of the first and second metals, the first metal ions can be satisfactorily reduced. Furthermore, since a reducing agent is not used, without the occurrence of problems concerning co-deposits and the bath life as mentioned above, a satisfactory plated layer can be formed.

Therefore, the contents of the abovementioned presentation do not suggest the present invention, but are only equivalent to the prior-art.

PREFERRED EMBODIMENTS OF THE INVENTION

Figure 1:
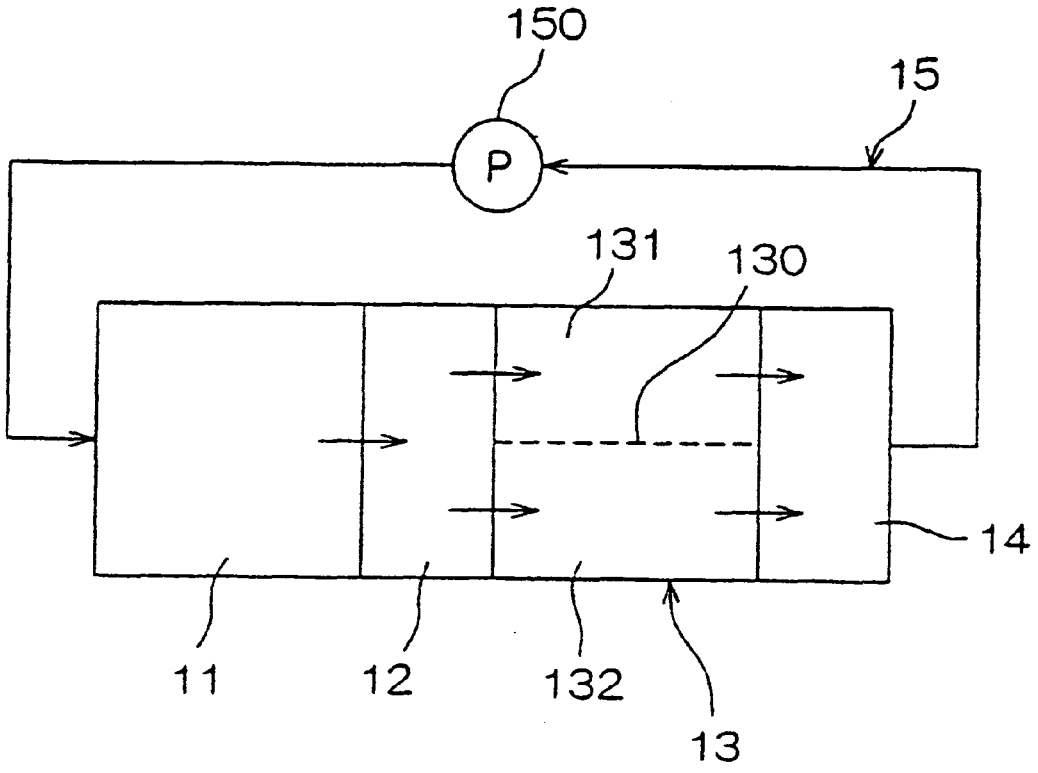
FIG. 1 is a schematic view showing the arrangement of the continuous plating apparatus used in Example 6 of the invention.

The foregoing and other features and advantages of the present invention will become more readily appreciated as the same becomes better understood by reference to the following detailed description when taken in conjunction with the accompanying drawings.

First, the plating method of the invention shall be described.

The plating method of the invention is characterized in that, before carrying out the process for reducing and depositing the second metal ions onto the surface of an object to be plated by the redox system electroless plating method, a process is added in that the first metal ions of the redox system of the plating bath are reduced from a higher oxidation state to a lower oxidation state by supplying the electrical current to the plating bath to thereby activate the plating bath as mentioned above.

Also, in the plating method of the invention, the reduction and deposition of an alloy formed from two or more kinds of metals such as the abovementioned solder (tin-zinc alloy) are possible. Therefore, in the present specification, "the second metal" includes alloys formed of two or more kinds of metals as well as a single metal. Also, the second metal ions include ions of two or more kinds of metals composing said alloys.

The process of activation can be carried out at an optional point in time during the plating process; however, it is preferable that it is carried out prior to the plating process. If the process of activation is thus carried out prior to the plating process, plating baths in various conditions, such as a new plating bath immediately after being prepared, a plating bath whose activity is lowered as time passes, an old plating bath after being used once and almost completely loosing activity, or a plating bath precursor of the invention which does not possess activity at all are activated to the same condition as that of the new plating bath immediately after being prepared, and can be used for the plating process. Therefore, without selecting the condition of the plating bath, an excellent plated layer can always be formed.

Also, the process of activation can be carried out simultaneous with the plating process, and in this case, since the activation state of the plating bath is maintained, for example, as in the electroplating method, it enables the continuous use of the plating bath over a long period of time, and productivity is improved.

It is preferable that the process of activation be carried out in a preparation tank separately provided from the plating tank. In particular, when the process of activation is carried out simultaneous with the plating process, if considering continuity of the plating operation, it is desirable that a plating bath which is activated in a preparation tank and enabled for use for plating be intermittently or continuously supplied into the plating tank.

As mentioned above, as a preparation tank for the process of activation prior to the plating process or simultaneous with the plating process, a preparation tank which is equipped with both the cathode and anode for supplying the electrical current to the plating bath, and divided into a cathode chamber containing a cathode electrode and anode chamber containing an anode electrode by means of a partition film such as an ion exchange membrane is preferably used.

In a case where such a preparation tank is used, since the first metal ions in a lower oxidation state which are reduced by means of a cathode reaction are prevented from being oxidized again due to an anode reaction, the bath can be efficiently activated.

Also, in the process of activation using the abovementioned preparation tank, it is preferable to use an electrode made from the same metal as that of the second metal ions (in a case of a second metal alloy, made from the same metal alloy) as an anode from among both the cathode and anode to be used for supplying the electrical current. When such an electrode is used as an anode, since the second metal ions can be supplied to the bath by an anode dissolving reaction in the anode chamber simultaneous with activation of the plating bath by a cathode reaction in the cathode chamber, the composition of the bath can be easily regenerated or maintained.

The conditions for activation are not particularly limited, however, for efficient and smooth reduction of the first metal ions in the cathode chamber by a cathode reaction, it is preferable that the plating bath be added with acids such as hydrochloric acid and sulfuric acid, and the pH adjusted to 7 or less, more preferably, 3 or less.

Also, in order to supply electrical current to the plating bath, a voltage to be applied between both cathode and anode and a bath temperature in activation is properly set in accordance with the type and amount of the plating bath and the capacity and structure of the tank for activation.

Also, it is preferable that the electrical current density at the cathode when supplying an electrical current to the plating bath is more than the limit electrical current density of electrodeposition of the second metal ions in the plating bath. The reason for this is as follows:

In this process of activation, a part of the second metal ions may be reduced and deposited onto the surface of the cathode together with the first metal ions. If the cathode in which the second metal ions are deposited onto the surface is used as an anode in the next process of activation, no loss arises in material balance since it can be used for supplying the second metal ions to the plating bath by the abovementioned anode dissolving reaction.

However, the first object of the process of activation is to reduce the first metal ions absolutely as mentioned above, whereby it is important that deposition of the second metal ions is suppressed as low as possible, and therefore, it is preferable that the electrical current density at the cathode when supplying an electrical current to the plating bath is set to greater than the limit electrical current density of electrodeposition of the second metal ions in the plating bath.

Thus, in case that the plating bath activated in the cathode chamber is mixed with the bath supplied with the second metal ions in the anode chamber, followed by that the concentration is adjusted as necessary, and furthermore, prior to activation, the pH of the bath is adjusted as described above, a plating bath activated so as to be used for the plating process can be obtained by re-adjustment in pH with adding alkali to the bath to be within a range in which the plating process by means of a redox reaction, that is, oxidation of the first metal ions and following reduction and deposition of the second metal ions proceed smoothly, that is, pH 6 or more, more preferably, within a range of 8–9. As alkali for adjusting the bath in pH to be within the abovementioned range, various alkalis which are conventionally and generally known, for example ammonia, carbonate such as sodium carbonate and potassium carbonate, or sodium hydroxide and potassium hydroxide, or the like can be used.

Furthermore, in order to more efficiently and rapidly activate the plating bath while waste deposition of second metal ions onto the cathode is nearly eliminated, and while maintaining the pH of the bath to a fixed value within the abovementioned range suitable for the plating process by means of the redox reaction without repeating adjustments and readjustments of the pH of the bath, it is preferable that, when carrying out the process of activation in the preparation tank which is divided into both the cathode and anode chambers by the partition film as mentioned above, (1) an ion exchange membrane is used as the partition film, (2) among both the cathode and anode, at least the cathode is made from carbon, and (3) the plating bath to be activated is supplied to only the cathode chamber and recovered from only the cathode chamber.

As an ion exchange membrane to be used as the partition film, among various resin-based films, a negative-ion exchange membrane is preferable so that the first and second metal ions contained in the plating bath to be processed are prevented from moving to the anode chamber, and also, an olefin-based or fluorine-based ion exchange membrane is preferable so that the plating bath is stable in pH within an alkali range of approximately pH 8–9 for a long period of time.

It is preferable that the thickness of the abovementioned ion exchange membrane is approximately 25 through 400 $\mu$m, and more preferably, approximately 50 through 200 $\mu$m. If the thickness of the ion exchange membrane is less than the abovementioned range, the degree of mixing of the baths in both cathode and anode chambers may be increased. To the contrary, if the thickness of the ion exchange membrane exceeds the upper limit of the abovementioned range, electrical resistance increases, and a large amount of gasses generate when activating the plating bath, whereby activation efficiency may be lowered.

Also, a carbon electrode is used especially as a cathode among both the cathode and anode, which is preferably formed from porous carbon with a specific surface area of 1 $m^2/g$ or more. More preferably, 30–70 $m^2/g$, for example, felt made from carbon fibers with a diameter of approximately 7– 8 $\mu$m is preferably used, when considering improvements in processing efficiency by increasing the area contacted with the bath.

Also, it is preferable that the carbon electrode has a surface applied with oxidation processing so that the regeneration and activation speed of the plating bath is increased, and deposition of the second metal ions is more securely prevented, and as such a concrete method for oxidation processing, for example, anodic oxidation processing in which a DC voltage of approximately 5V is applied for 3 through 5 minutes in an electrolysis solution of dilute sulfuric acid with a concentration of approximately 10% by using a carbon-made electrode as an anode is preferable.

By this anodic oxidation processing, for example, the electrode formed from porous carbon such as carbon felt can be efficiently and evenly oxidized up to the surface inside the pores.

The anodic oxidation processing is preferably carried out immediately before using the carbon electrode to activate the plating bath.

For example, when activating a plating bath containing titanium ions as the first metal ions and nickel ions as the second metal ions, since the functional groups C═O and ≡C—OH at the surface selectively react with only the titanium ions to promote reduction of said titanium ions, the abovementioned carbon-made electrode can activate the plating bath more efficiently and rapidly while preventing deposition of nickel to the cathode.

The promotion of selective reduction of the first metal ions by such a reaction mechanism is also applicable in a system containing various metal ions whose oxidation and reduction potential is expressed as 1.03V or less in hydrogen reference electrode potential as the second metal ions as well as a system containing nickel ions as the second metal ions as mentioned above when the first metal ions are titanium ions, for example. As such second metal ions, there are cobalt, tin, and lead ions.

When the plating bath to be activated is supplied only to the cathode chamber and recovered only from the cathode chamber, in addition to the same plating bath, a solution containing various electrolytes, for example, acid such as sulfuric acid, alkali such as potassium hydroxide, or salt, can be used as an anode liquid to be supplied to the anode chamber, and in particular, dilute sulfuric acid with a concentration of 10% is preferably used since it is excellent in the aspect of activation speed of the plating bath and in effect for suppressing gasses when activating.

The voltage to be applied to both the cathode and anode to activate the plating bath is properly set to be within a range in which the plating bath can be efficiently activated, that is, a range in which only the first metal ions can be efficiently reduced without reducing and depositing the second metal ions in accordance with the combination of first and second metal ions contained in the plating bath to be activated.

For example, when activating a plating bath containing titanium ions as the first metal ions and nickel ions as the second metal ions, the voltage to be applied to both the cathode and anode is approximately 2 through 5V, more preferably, 2.5 through 3.0V. If the voltage is below this range, tetravalent titanium ions ($Ti^{4+}$) may not be reduced to trivalent ($Ti^{3+}$), and to the contrary, if the voltage exceeds the upper limit of the range, since gas generation becomes more dominant than reduction of titanium ions, the plating bath may not be efficiently activated.

Also, by the abovementioned activating method, since the second metal ions cannot be supplied to the plating bath, it is preferable that metals or their compounds which are the sources of the second metal ions are added to the plating bath at either point before or after the activation processing in this case. For example, when the second metal ions are nickel ions, nickel powder of carbon nickel or the like, or nickel compounds of nickel sulfate or the like can be added to the plating bath as an ion source.

The plating process using the plating bath activated in the abovementioned process of activation can be carried out in the same way as in the normal redox system electroless plating method.

That is, via the process of activation, if an object to be plated is dipped in the bath for a fixed period of time while maintaining a constant bath temperature, the second metal ions are reduced and deposited onto the surface of said object to be plated, and a plated layer is formed.

The plating bath temperature and the dipping period time of the object to be plated may be properly set in accordance with the material, shape, and structure of said object to be plated, the thickness of the plated layer to be formed, and the kind of plating bath.

The surface of the object to be plated can be pretreated in advance so that the plated layer can be smoothly formed with excellent adhesion. However, by the plating method of the invention, the plated layer may be directly formed without catalysis treatment onto the surface of the object to be plated by palladium compounds in advance as in the prior-art conventional electroless plating, wherein this case has an advantage whereby cost for plating products can be reduced, and therefore, it is preferable that pretreatment, in particular, catalysis treatment by expensive palladium compounds is omitted, if possible.

After the plating process is completed, the plating bath can be used for the next plating process by being immediately activated, or stored until the next use in a stable condition as a plating bath precursor by oxidizing the first metal ions naturally or forcibly by means of electrolyzing oxidation.

As the plating bath to be used in the plating method of the invention, a solution in which the first and second metal ions and a complex forming agent and stabilizer for stable existence of these metal ions are dissolved into water at predetermined ratios can be used.

As mentioned above, such a plating bath can be used in various conditions, that is, a new condition immediately after being prepared, a condition where activity is lowered after some time has passed since it has been prepared, or an old condition after the bath is used once and activity is almost lost, and in addition, in a condition as a plating bath precursor of the invention without activity. In all cases mentioned above, by the invention, due to the abovementioned process of activation, the plating baths in all conditions can be used for the plating process in a condition where the baths are activated to the same degree as the new plating bath immediately after being prepared.

The plating bath precursor of the invention contains the abovementioned components, and as mentioned above, made in a stable condition where reduction and deposition of the second metal ions do not occur.

In such a plating bath precursor of the invention, even if it is stored for a long period of time, since the second metal ions contained in the bath are not freely reduced and deposited, whenever necessary, the bath is regenerated and activated to a condition enabling plating merely by supplying the electrical current and reducing the first metal ions from a higher oxidation state to a lower oxidation state, whereby the bath can be used as a plating bath, and furthermore, the bath is excellent in storing performance.

As the first metal ions composing the redox system in the abovementioned plating bath precursor and the plating bath formed by activating the precursor, for example, there is at least one kind of metal ion selected from titanium, cobalt, tin, vanadium, iron, and chromium although it is not limited to these. Among these, ions composing a redox system by which the second metal ions as a plating subject can be reduced and deposited are selected and used.

For example, when the second metal ions are nickel ions ($Ni^{2+}$), it is preferable that titanium ions are used as the first metal ions to compose a redox system in the bath that is expressed as follows:

$$Ti^{3+} \rightarrow Ti^{4+} + e^-$$

Also, when the second metal ions are copper ions ($Cu^{2+}$ or $Cu^-$) or silver ions $Ag^+$it is preferable that cobalt ions are used to compose a redox system in the bath which is expressed as follows:

$$Co^{2+} \rightarrow Co^{3+} + e^-$$

The plating bath precursor of the invention must be substantially in a stable condition where reduction and deposition of the second metal ions do not occur as mentioned above.

For example, when titanium ions are used as the first metal ions of a redox system expressed as:

$$Ti^{3+} \rightarrow Ti^{4+} + e^-,$$

most titanium ions in a stable tetravalent ion ($Ti^{4+}$) condition are contained in the bath, whereby said bath can be made in a stable condition where reduction and deposition of the second metal ions do not occur. As a concrete method, for example, the bath is prepared by being blended with a material of a tetravalent compound such as titanium tetrachloride ($TiCl_4$), or almost the entire amount of trivalent ions ($Ti^{3+}$) in the bath may be oxidized to tetravalent ions ($Ti^{4+}$) by being naturally left or forcibly electrolyzed.

Also, when cobalt ions are used as the first metal ions of a redox system expressed as:

$$Co^{2+} \rightarrow Co^{3+} + e^-,$$

by the same method as mentioned above, most cobalt ions may be contained in the bath in a stable trivalent ion ($Co^{3+}$) condition.

Furthermore, when tin ions are used to compose a redox system expressed as:

$$Sn^{2+} \rightarrow Sn^{4+} + 2e^-,$$

in the same manner as mentioned above, most tin ions may be contained in the bath in a stable tetravalent ion ($Sn^{4+}$) condition.

The same manner can be applied to other metals.

The concentration of stable ions in a higher oxidation state of the first metal per 1 liter of the plating bath is not limited, but preferably approximately 0.0005 mole/liter or more, and more preferably, 0.001 mole/liter.

According to examinations conducted by the inventors, when the concentration of stable ions in the higher oxidation state is less than this range, even if supplying an electrical current, ions in a lower oxidation state cannot be generated at a sufficient speed to a degree of concentration required for reduction and deposition of the second metal ions, whereby the bath may not be activated.

Also the upper limit of the concentration of stable ions in a higher oxidation state of the first metal is not particularly limited, however, when considering prevention of deposition of a large amount of first metal ions together with the second metal ions resulting in a lowering of the purity of the plated layer, the concentration of stable ions in a higher oxidation state is preferably about 0.5 mole/liter or less, and more preferably, 0.2 mole/liter or less.

Furthermore, when titanium is used as the first metal as mentioned above, the concentration of stable ions in a higher oxidation state of titanium in the plating bath precursor, that is, the concentration of tetravalent ions ($Ti^{4+}$) is preferably 0.001 through 0.1 mole/liter in particular within the abovementioned range, and more preferably, about 0.005 through 0.05 mole/liter.

On the other hand, when cobalt is used as the abovementioned first metal, the concentration of stable ions in a higher oxidation state of said cobalt in the plating bath precursor, that is, the concentration of trivalent ions ($Co^{3+}$) is preferably 0.01 through 0.3 mole/liter in particular within the abovementioned range, and more preferably, 0.05 through 0.2 mole/liter.

As the second metal, various metal ions which become plating subjects can be used, however, in particular, one or more metal ions selected from nickel, cobalt, gold, silver, copper, palladium, platinum, indium, tin, lead, antimony, cadmium, zinc, and iron ions is preferably used.

As a complex forming agent and stabilizer for stable existence of the first and second metal ions in the bath, for example, carboxylic acids such as ethylenediamine, citric acid, tartaric acid, nitrilotriacetic acid (NTA), and ethylenediaminetetraacetic acid (EDTA), and derivatives such as sodium salt, potassium salt, and ammonium salt can be used.

Such two or more kinds of complex forming agents and stabilizers can be used corresponding to the combination of the kinds of first and second metal ions.

Also, the concentrations of the complex forming agents and stabilizers can be properly set in accordance with the concentrates of the first and second metal ions to be contained in the bath, however, normally, it is approximately 0.001 through 2 mole/liter, more preferably, 0.01 through 1 mole/liter.

Also, a pH adjusting agent such as ammonia for adjusting the pH of the precursor to a preferable range, a pH buffering agent such as boric acid and ammonium borate for stabilizing the bath pH, or a stabilizer for preventing the second metal ions from being reduced in the bath can be added to the plating bath precursor.

Among them, the concentration of the pH-buffering agent is preferably 0.001 through 0.2 mole/liter. If the concentration of the pH buffering agent is below this range, a sufficient stabilization effect of the bath pH may not be obtained, and to the contrary, if it exceeds the upper limit of the range, the pH buffering agent is deposited when the bath temperature is lowered to below room temperature, whereby regeneration and activation of the bath may become difficult.

Also, as stabilizers for stabilizing the second metal ions, for example, when the second metal ions are nickel ions, among combinations of metal ions mainly containing lead (Pb, Sn, As, Tl, Mo, In, Ga, Cu, and the like) and an iodide such as $KIO_3$, or sulfur-containing compounds such as thiourea and thiodiglycolic acid, one or two kinds can be used.

Furthermore, various additives which are added to the prior-art conventional electroless plating bath, for example, an antioxidant such as ascorbic acid and a stabilizer such as 2,2'-bipyridine can be added in proper ratios to the plating bath precursor.

EXAMPLES

Hereinafter, the invention shall be described on the basis of Examples. and Reference examples. The plating baths and plating bath precursors used in these examples have the following compositions 1 through 4.

<Composition 1: Nickel Plating Bath Precursor>

| (Components) | (Concentration) |
|---|---|
| $Ti^{4+}$ (added as a solution in which titanium tetrachloride is dissolved into a sodium citrate solution): | 0.01 mole/liter |
| $Ni^{2+}$ (added as a solution of nickel sulfate): | 0.02 mole/liter |
| Sodium citrate (total amount including sodium citrate in the abovementioned $Ti^{4+}$ solution): | 0.03 mole/liter |
| Sodium tartrate: | 0.04 mole/liter |
| Acid sodium nitrilotriacetic: | 0.02 mole/liter |

The remaining amount of the plating bath precursor was water, and the pH of the bath was adjusted to 8 by adding ammonia.

<Composition 2: Nickel Plating Bath>

| (Components) | (Concentration) |
|---|---|
| $Ti^{3+}$ (added as a hydrochloric acid solution of titanium trichloride): | 0.01 mole/liter |
| $Ni^{2+}$ (added as a solution of nickel sulfate): | 0.02 mole/liter |
| Sodium citrate: | 0.03 mole/liter |
| Sodium tartrate: | 0.04 mole/liter |
| Acid sodium nitrilotriacetic: | 0.02 mole/liter |

The remaining amount of the plating bath was water, and the bath pH was adjusted to 8 by adding ammonia.

<Composition 3: Nickel Plating Bath>

| (Components) | (Concentration) |
|---|---|
| $Ti^{3+}$ (added as a hydrochloric acid solution of titanium trichloride): | 0.05 mole/liter |
| $Ni^{2+}$ (added as a solution of nickel sulfate): | 0.10 mole/liter |
| Sodium citrate: | 0.15 mole/liter |
| Sodium tartrate: | 0.20 mole/liter |
| Acid sodium nitrilotriacetic: | 0.10 mole/liter |

The remaining amount of the plating bath was water, and the bath pH was adjusted to 8 by adding ammonia.

<Composition 4: Copper Plating Bath>

| (Components) | (Concentration) |
|---|---|
| $Co^{2+}$ (added as a solution of cobalt nitrate (II)): | 0.15 mole/liter |
| $Cu^{2+}$ (added as a solution of copper (II) chloride): | 0.05 mole/liter |
| Ascorbic acid | 0.01 mole/liter |
| Ethylenediamine | 0.6 mole/liter |
| 2,2'-bipyridine | 20 ppm |

The remaining amount of the plating bath was water, and the bath pH was adjusted to 1 by adding hydrochloric acid.

Example 1

(Activation Process)

Hydrochloric acid was added to the nickel plating bath precursor of the abovementioned composition 1 to be adjusted in pH to 1, and then, 1 liter of the bath precursor was poured into each cathode chamber and anode chamber divided by the partition film in the preparation tank for activation, and activation processing was carried out by supplying the electrical current under the following conditions:

Cathode: Platinum-coated titanium plate

Anode: Platinum-coated titanium plate

Current density at the cathode: 15 $A/dm^2$

Processing time: 2 hours

Bath temperature: 25° C.

(Plating Process)

2 liters in total of the plating bath processed by the abovementioned activation process in cathode and anode chambers were poured into the plating tank, and added with ammonia to be adjusted in pH to 8.

Thereafter, while maintaining the dipping temperature at 40° C., an ABS resin plate which was treated with palladium catalysis in accordance with a conventional method in advance was used as an object to be plated, and applied with nickel plating by being dipped in the plating bath for 10 minutes. The obtained nickel-plated layer was approximately 0.6 μm in thickness.

Also when the nickel plating bath precursor of the abovementioned composition 1 was poured into a beaker, left for a week, applied with activation processing under the same conditions as in the above Example 1, and plated (Example 2), it was confirmed that a nickel plated layer with a thickness of approximately 0.5 μm was formed on the surface of the ABS resin plate applied with palladium catalysis processing.

Example 3

The nickel plating bath of the abovementioned composition 2 was prepared, poured in a beaker, left for an entire day and night, and then 2 liters of the bath were poured into the plating tank, into which an ABS resin plate treated with palladium catalysis was dipped for 10 minutes while maintaining the dipping temperature at 40° C. However, a nickel plated layer was not formed on the surface, and it was confirmed that the plating bath had lost activity.

Therefore, hydrochloric acid to be adjusted in pH to 1 was added to this plating bath, and then 1 liter of the bath was poured into each cathode chamber and anode chamber which were divided by the partition film in the preparation tank for activation, and applied with activation processing under the same conditions as in the above Example 1.

And, when 2 liters in total of the processed plating baths in the cathode and anode chambers were poured into the plating tank and mixed, added with ammonia to be adjusted in pH to 8, into which an ABS resin plate treated with palladium catalysis was dipped for 10 minutes while maintaining the dipping temperature at 40° C., it was confirmed that a nickel plated layer with a thickness of approximately 0.7 μm was formed.

Example 4

The plating bath which was applied with nickel plating processing in the above Example 1 was recovered, and added with hydrochloric acid to be adjusted in pH to 1. Then, 1 liter of the bath was poured into each cathode chamber and anode chamber divided by the partition film in the preparation tank for activation again, and activated under the same conditions as in the above Example 1. However, in this case, a nickel electrode plate was used as the anode.

Then, when 2 liters in total of the plating baths in the cathode and anode chambers were poured into the plating tank, adjusted in pH to 8 with the addition of ammonia, and an ABS resin plate treated with palladium catalysis was dipped in the bath for 10 minutes while maintaining the dipping temperature at 40° C., it was confirmed that a nickel plated layer with a thickness of approximately 0.6 μm was formed.

Also, when the plating bath after being applied with nickel plating processing in the above Example 3 was recovered, and applied with activation processing under the same conditions as in the above Example 4, and used for plating (Example 5), it was confirmed that a nickel plated layer with a thickness of approximately 0.6 μm was formed on the surface of the ABS resin plate treated with palladium catalysis.

Reference Example 1

When 2 liters of the nickel plating bath of the abovementioned composition 2 was, immediately after being prepared, poured into the plating tank, and an ABS resin plate treated with palladium catalysis was dipped in the bath for 10 minutes while maintaining the dipping temperature at 40° C., it was confirmed that a nickel plated layer with a thickness of approximately 0.8 μm was formed.

From the above results, it was confirmed that, by the plating method of the invention, regardless of the degree of activation of the plating baths (Examples 3 through 5), or by using the plating bath precursor without activity (Examples 1 and 2), a plated layer equivalent to that in a case where the plating bath immediately after being prepared was used (Reference example 1) could be formed. Also, from the results of Examples 1 and 2, it was confirmed that the plating bath precursor could be stored for a long period of time.

Example 6

(Manufacturing of Continuous Plating Apparatus)

A continuous plating apparatus shown in FIG. 1 was manufactured so that the process for activating the bath by supplying the electrical current was carried out at the same time as the plating process in the preparation tank, and plating was continuously carried out by continuously supplying the activated bath to the plating tank.

In the continuous plating apparatus shown in the figure, plating tank 11, first adjusting tank 12 for adjusting pH of the plating bath to a value suitable for activation after being used for plating, preparation tank 13 divided into cathode chamber 131 and anode chamber 132 by ion exchange membrane 130 for activating the bath adjusted in pH, and second adjusting tank 14 for adjusting the bath after being activated in pH to a value suitable for plating are disposed the plating bath to flow automatically between the tanks in the order as shown by the solid arrow in the figure by means of overflow. The second adjusting tank 14 and the plating tank 11 are connected by piping 15 provided with pump 150 at the middle so that the bath which flows to the second adjusting tank 14 circulates to the plating tank 11.

Also, among tanks comprising the above continuous plating apparatus, the capacity of the plating tank 11 was 2 liters, and each of the capacity of the first adjusting tank 12, cathode chamber 131 and anode chamber 132 of the preparation tank 13, and the second adjusting tank 14 was 1 liter.

Also, in the abovementioned apparatus, flowing rate of bath overflowing from the first adjusting tank 12 to the cathode chamber 131 and anode chamber 132 were set to almost equal.

Also, as the cathode, a platinum-coated titanium plate with an area of 0.07 $dm^2$ was used, and as the anode, nickel with an area of approximately 1.3 $dm^2$ was used.

(Continuous Plating Process)

The nickel plating bath of the abovementioned composition 3 was used for the continuous plating apparatus, and the activation process and plating process were simultaneously carried out as mentioned above while the pump 150 was activated to circulate the bath between tanks 11 through 14, and continuous plating was carried out onto a urethane resin plate of 5 cm×7 cm while supplying the activated bath to the plating tank.

As conditions, the bath temperature was set to 40° C., the electrical current density of the cathode in the preparation tank 13 was set to 15 $A/dm^2$, the plating time onto one urethane resin plate (dipping time in the bath) was set to 30 minutes, and an interval of 30 minutes was provided until the next urethane resin plate was dipped in the bath. Also, in the first adjusting tank 12, sulfuric acid was dripped to adjust the bath pH to 2, and in the second adjusting tank 14, potassium hydroxide was dripped to adjust the bath in pH to 8.

Under the abovementioned conditions, when continuous plating was carried out while changing urethane resin plates, a nickel plated layer with almost the same thickness as that of the first through sixth plates could also be formed on the seventh urethane resin plate.

From this result, it was confirmed that the plating bath could be continuously used by the plating method of the invention.

Example 7

(Activation Process)

The copper plating bath of the abovementioned composition 4 was left for some time after being prepared, and then 1 liter of the bath was poured into each cathode chamber and anode chamber divided by the partition film in the preparation tank for activation, and activation processing was carried out by supplying the electrical current under the following conditions.

Cathode: Platinum-coated titanium plate

Anode: Platinum-coated titanium plate

Current density at the cathode: 20 $A/dm^2$

Processing time: 2 hours

Bath temperature: 25° C.

(Pretreatment Processing of an Object to be Plated)

A silicon wafer as an object to be plated was pretreated by dipping in a pretreatment bath of the following composition 5 for 1 minute.

<Composition 5: Pretreatment Bath>

| (Components) | (Concentration) |
|---|---|
| $CuCl_2$: | 0.01 mole/liter |
| HF: | 10% |
| $NH_4F$ | 10% |

(Plating Process)

The plating baths (2 liters in total) in the cathode and anode chambers which were processed in the abovementioned activation process were poured into the plating tank and mixed, adjusted in pH to 6.7 with the addition of ammonia, and then, the silicon wafer pretreated in the pretreatment process was dipped in the bath for 10 minutes and applied with copper plating. The thickness of the obtained copper plated layer was approximately 0.6 $\mu$m.

From the results of the abovementioned Example 7, it was confirmed that an excellent plated layer could be formed also in copper plating, according to the invention.

Example 8

(Preparation of a Nickel Plating Bath)

The following baths A through D were prepared which were to be the bases of a nickel plating bath.

<Composition A>

| (Components) | (Concentration) |
|---|---|
| Nickel sulfate: | 0.08 mole/liter |
| Trisodium citrate: | 0.4 mole/liter |
| Acid sodium nitrilotriacetic: | 0.08 mole/liter |

The remaining amount of bath A is water, and small amounts of lead, indium, and sulfur-containing compounds were added as nickel ion stabilizers.

<Composition B>

| (Components) | (Concentration) |
|---|---|
| Titanium tetrachloride: | 0.5 mole/liter |
| Trisodium citrate: | 0.5 mole/liter |
| Ammonia: | 140 milliliter/liter |

The remaining amount of bath B is water.

<Composition C>

| (Components) | (Concentration) |
|---|---|
| Titanium trichloride: | 0.08 mole/liter |

The remaining amount of bath C is water.

<Composition D>

| (Components) | (Concentration) |
|---|---|
| Ammonium borate: | 13.5 g/liter |

The remaining amount of bath D is water.

Next, by mixing baths A through D in predetermined ratios, a nickel plating bath was prepared so that the concentrations of the respective components were the following values as shown in composition 6 below.

<Composition 6: Nickel plating bath>

| (Components) | (Concentration) |
|---|---|
| $Ti^{4+}$: | 0.04 mole/liter |
| $Ti^{3+}$: | 0.04 mole/liter |
| $Ni^{2+}$: | 0.04 mole/liter |
| Trisodium citrate: | 0.24 mole/liter |
| Sodium nitrilotriacetate: | 0.04 mole/liter |
| Ammonia: | 11 milliliter/liter |
| Ammonium borate: | 0.05 g/liter |

The remaining amount of the bath is water, and as mentioned above, the bath contains small amounts of lead, indium and sulfur-containing compounds such as nickel ion stabilizers. The bath pH is 8.

(Manufacturing of an Activation Apparatus)

Figure 2:
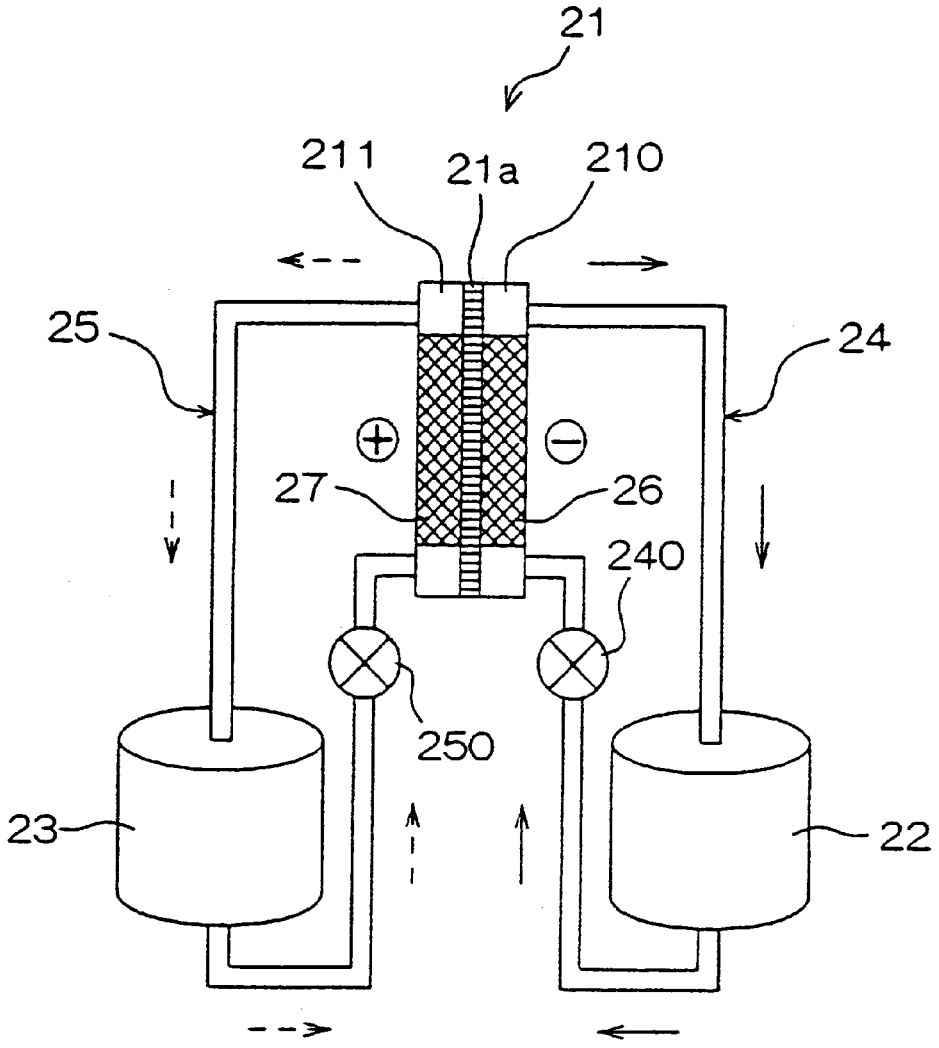
FIG. 2 is a schematic view showing the arrangement of the activation apparatus used in Examples 8 and 9 of the invention.

As an apparatus equipped with a preparation tank for carrying out the activation process by supplying the electrical current to the plating bath, an activation apparatus as shown in FIG. 2 was manufactured.

The activation apparatus shown in the figure is equipped with preparation tank 21 which is divided into cathode chamber 210 and anode chamber 211 by ion exchange membrane 21*a,* plating tank 22 for storing plating bath to be supplied to the cathode chamber 210, and anode liquid chamber 23 for storing an anode liquid to be supplied to the anode chamber 211, wherein, in order to circulate the plating bath stored in the plating tank 22 between the tank and the cathode chamber 210 as shown by the solid arrow in the figure, the tank and the chamber are connected by piping 24 provided with circulation pump 240 at the middle, and in order to circulate the anode liquid stored in the anode liquid tank 23 between the tank and the anode chamber 211 as shown by the arrow of the broken line in the figure, the tank and the chamber are connected by piping 25 provided with circulation pump 250 at the middle.

Also, in the above apparatus, inside the cathode chamber 210 and anode chamber 211, sheet-shaped cathode 26 and anode 27 which are formed of felt with specific surface areas of 50 $m^2/g$ made from carbon fibers of approximately 7 through 8 $\mu$m diameters, and whose thickness are almost equal to the inner widths of the cathode chamber 210 and anode chamber 211, respectively, are disposed in a laminated condition where the cathode and anode are adhered to both surfaces of the ion exchange membrane 210.

By the abovementioned arrangement, the plating bath supplied from the plating tank 22 to the cathode chamber 210 via the first half section of the piping 24 passes through the pores of the felt forming the cathode 26, and when it passes the cathode, the plating bath is activated by a voltage applied between both the cathode 26 and anode 27 from an unillustrated power supply apparatus, and then returned to the plating tank 22 via the latter half section of the piping 24. Likewise, the anode liquid supplied to the anode chamber 211 from the anode liquid tank 23 via the first half section of the piping 25 passes through the pores of the felt forming the anode 27, and when it passes through the anode, the plating bath is used for activating the plating bath by the abovementioned voltage, and then returned to the anode tank 23 via the latter half section of the piping 25.

Also, in order to apply a voltage to the entire sheet surfaces of the felts forming both the cathode 26 and anode 27, the cathode 26 and anode 27 are formed as electrode plates for connecting wiring from the power supply apparatus by adhering electric conductive waterproof sheets (not illustrated) to the entire surfaces opposite to the sides of the sheets adhered to the ion exchange membrane 210.

Furthermore, as the ion exchange membrane, an olefin-based negative-ion exchange membrane with a thickness of 150 $\mu$m was used.

(Activation Test)

The nickel plating bath of the abovementioned composition 6 was poured into the plating tank, and used under the same conditions as in the above Examples 1 through 5 and Reference example 1 until plating becomes impossible, and 1 liter of the plating bath was stored in the plating tank 22 of the activation apparatus of FIG. 2, and 1 liter of dilute sulfuric acid at a concentration of 10% was stored in the anode tank 23 of the apparatus.

In both tanks 22 and 23, in order to prevent the plating bath and anode liquid from the effects of oxygen in the atmosphere, a nitrogen gas was continuously supplied during the activation test.

The carbon felt sheet to be used for the cathode 26 was applied with anode oxidation processing of 5V for 3 minutes in 10% dilute sulfuric acid by using a cell separately prepared for anode oxidation immediately before the activation test.

And, while circulating the plating bath and anode liquid by operating the pumps 240 and 250 of the apparatus of FIG. 2, a voltage of 2.8V was applied between both cathode 26 and anode 27 to continuously carry out activation processing for the plating bath. At this, when the time required for reduction of 50 mole % of the tetravalent titanium ions ($Ti^{4+}$) contained in the plating bath in the plating tank 22 was measured while sampling the plating bath, the result of the measurement was 30 minutes.

Also, when the plating bath in the plating tank 22 which was applied with activation processing for 30 minutes as mentioned above was taken out, adjusted with the addition of a solution of nickel sulfate so that the concentration of the nickel ions ($Ni^{2+}$) was 0.04 mole/liter, and then plating processing was carried out under the same conditions as in the above Examples 1 through 5 and Reference example 1, it was observed that a nickel plated layer was formed on the surface of the ABS resin plate applied with palladium catalysis treatment. From this result, it was confirmed that the plating bath was activated so as to be used for plating by the abovementioned processing.

For comparison, when the same carbon felt sheet to be used for the cathode 26 was used for the abovementioned activation process without being anode-oxidized, and the time required for reduction of 50 mole % of the tetravalent titanium ions ($Ti^{4+}$) contained in the plating bath in the plating tank 22 to trivalent ions ($Ti^{3+}$) was measured, the result of the measurement was 90 minutes.

Furthermore, when a nickel foil wound so as to have roughly the same surface area as that of the felt sheet was used as the cathode 26, in place of the carbon felt sheet, the time required for reduction of 50 mole % of titanium tetravalent ions ($Ti^{4+}$) contained in the plating bath in the plating tank 22 to trivalent ions ($Ti^{3+}$) was 360 minutes.

Example 9

(Activation Test)

When the copper plating bath of the abovementioned composition 4 was poured into the plating tank, immediately after being prepared, and adjusted in pH to 6.8 with the addition of nitric acid, and an ABS resin plate which was washed in water after being pretreated for 1 minute by 3N hydrochloric acid was dipped in the bath for 1 hour while maintaining the dipping temperature at 50° C., it was confirmed that a plated layer with a thickness of approximately 2 $\mu$m was formed. The dipping load at this time was 40 $cm^2$/liter.

Next, 1 liter of the bath which lost activity after being used for the plating processing was stored in the plating tank 22 of the activation apparatus of FIG. 2, and as an anode liquid, 1 liter of dilute sulfuric acid with a concentration of 10% was stored in the anode liquid tank 23 of the apparatus.

In both tanks 22 and 23, as in the previous Example 8, in order to prevent the anode liquid from the effects of oxygen in the atmosphere, a nitrogen gas was continuously supplied during the activation test.

Also, as carbon felt sheets to be used for both the cathode 26 and anode 27, the same sheets as used in the Example 8, which were formed from carbon felt with specific surface areas of 50 $m^2$/g made from carbon fibers with diameters of approximately 7 through 8 $\mu$m, were used, and among these, the carbon felt sheet to be used for the cathode 26 was applied with anode oxidation processing of 5V for 3 minutes in 10% dilute sulfuric acid by using a cell separately prepared for anode oxidation immediately before the activation test.

Furthermore, an olefin-based negative-ion exchange membrane with a thickness of 150 $\mu$m was used as the ion exchange membrane.

And, while circulating the plating bath and anode liquid by operating the pumps 240 and 250 of the apparatus of FIG. 2, a voltage of 2.8V was applied between both cathode 26 and anode 27, activation processing of the plating bath was continuously carried out, and at this time, when the time required for reduction of 50 mole % of the trivalent cobalt ions ($Co^{3+}$) contained in the plating bath in the plating tank 22 was measured while sampling the plating bath, the result of the measurement was 15 minutes.

Also, when the plating bath in the plating tank 22 which was applied with activation processing for 30 minutes as mentioned above was taken out, added with a solution of copper (II) chloride so that the concentration of the copper ions ($Cu^{2+}$) was 0.05 mole/liter, and then plating processing was carried out under the same conditions as mentioned above, it was observed that a copper plated layer was formed on the surface of the ABS resin plate which was pretreated for 1 minute by 3N hydrochloric acid and washed in water. From this result, it was confirmed that the plating bath was activated so as to be used for plating by the abovementioned processing.

For comparison, when the same carbon felt sheet to be used for the cathode 26 was used for the abovementioned activation processing without being anode-oxidized, and the time required for reduction of 50 mole % of trivalent cobalt ions ($Co^{3+}$) contained in the plating bath in the plating tank 22 to bivalent ions ($Co^{2+}$) was measured, the result of the measurement was 25 minutes.

Furthermore, as the cathode 26, when a nickel foil which was wound so as to have the same surface area as that of the felt sheet was used in place of the carbon felt sheet, the time required for reduction of 50 mole % of trivalent cobalt ions ($Co^{3+}$) contained in the plating bath in the plating tank 22 to bivalent ions ($Co^{2+}$) was 90 minutes.

As described in detail above, by the invention, the effects can be obtained whereby a new plating method enables wide industrial use of the redox system electroless plating method having excellent characteristics, and a new plating bath precursor which is preferable for the new plating method can be provided.

What is claimed is:

1. A plating method, comprising oxidizing first metal ions of a redox system of a plating bath from a lower oxidation state to a higher oxidation state, and second metal ions of said redox system are reduced and deposited onto the surface of an object to be plated, wherein a process is provided in which by supplying an electrical current to the plating bath, the first metal ions are reduced from said higher oxidation state to said lower oxidation state to thereby activate the plating bath.

2. A plating method as in claim 1, wherein the process for activating the plating bath by supplying the bath with current is carried out prior to performing said plating method comprising reduction and deposition of the second metal ions.

3. A plating method as in claim 2, wherein the process for activating the plating bath by supplying the bath with current is carried out in a preparation tank which is divided into a cathode chamber and an anode chamber by means of a partition film.

4. A plating method as in claim 1, wherein the process for activating the plating bath by supplying the bath with current is carried out simultaneous with the plating method comprising reduction and deposition of the second metal ions.

5. A plating method as in claim 4, wherein the process for activating the plating bath by supplying the bath with electrical current is carried out in a preparation tank, and the activated plating bath is intermittently or continuously supplied to a plating tank.

6. A plating method as in claim 5, wherein the process for activating the plating bath by supplying the bath with current is carried out in a preparation tank which is divided into a cathode chamber and an anode chamber by means of a partition film.

7. A plating method as in claim 1, wherein the activation process is carried out by using as a cathode an electrode formed from the same metal as the second metal ions.

8. A plating method as in claim 1, wherein the process for activating the plating bath by supplying the bath with current is carried out in a preparation tank which is divided into a cathode chamber containing a cathode electrode and anode chamber containing an anode electrode by an ion exchange membrane utilized as a partition film while supplying a plating bath to be activated only to the cathode chamber and withdrawing the activated bath only from the cathode chamber, wherein at least said cathode electrode is a carbon electrode.

9. A plating method as in claim 8, wherein said carbon electrode comprises a porous carbon having a specific surface area of at least 1 $m^2$/g.

10. A plating method as in claim 8, wherein the surface of said carbon electrode is oxidized.

11. A plating method as in claim 10, wherein said carbon electrode is formed by anodic oxidation processing in an electrolyte solution.

12. A plating method as in claim 8, wherein said activation of the plating bath is carried out in the cathode chamber while supplying dilute sulfuric acid to the anode chamber as an anode liquid.

13. A plating method as in claim 8, wherein a metal or a compound thereof which can act as a source of the second metal ions is added to the activated plating bath before use.

* * * * *